United States Patent [19]

Leaney et al.

[11] Patent Number: 4,974,691

[45] Date of Patent: Dec. 4, 1990

[54] DOWN-HOLE BEARING ASSEMBLIES

[75] Inventors: Peter Leaney, Cheltenham, England; David McRobbie, Aberdeen, Scotland

[73] Assignee: Baroid Technology Inc., Houston, Tex.

[21] Appl. No.: 379,614

[22] Filed: Jul. 13, 1989

[30] Foreign Application Priority Data

Jul. 20, 1988 [GB] United Kingdom ..... 8817261
May 2, 1989 [GB] United Kingdom ..... 8910001

[51] Int. Cl.[5] ..... E21B 17/10

[52] U.S. Cl. ..... 175/325; 175/76; 166/241

[58] Field of Search ..... 175/325, 320, 326, 257, 175/309, 40, 76; 166/241, 242, 243

[56] References Cited

U.S. PATENT DOCUMENTS 2,228,649 1/1941 Welles ..... 175/325
2,973,996 3/1961 Self ..... 175/325
4,099,564 7/1978 Hutchison ..... 166/241

FOREIGN PATENT DOCUMENTS 0859597 9/1981 U.S.S.R. ..... 175/325

*Primary Examiner*—Ramon S. Britts
*Assistant Examiner*—Terry Lee Melius
*Attorney, Agent, or Firm*—Browning, Bushman, Anderson & Brookhart

[57] ABSTRACT

A rotating centralizer and a centralizing bearing assembly are provided in order to maintain a survey instrument assembly at a fixed angular orientation with respect to a core barrel supported by the bottomhole assembly of a rotating drill string and rotationally isolated therefrom. The centralizer comprises a sleeve having an inner bearing surface providing for rotation of the sleeve with respect to a support sub, and outer bearing surfaces located at the ends of four vanes allowing for rotation of the sleeve with respect to the surrounding drill string. The centralizing bearing assembly comprises a hanger sub, an outer sleeve which is a force fit within a hang-off sub of the drill string and an annular roller bearing unit surrounding the hanger sub and engaging the inner surface of the outer sleeve. The roller bearing unit comprises a plurality of tapered roller bearings having inclined axes of rotation. Such an arrangement is advantageous as it provides the required rotational isolation without the survey instrument assembly being subjected to substantial axial movement or torsion in operation.

8 Claims, 6 Drawing Sheets

DOWN-HOLE BEARING ASSEMBLIES

BACKGROUND OF THE INVENTION

This invention relates to down-hole bearing assemblies, for example for maintaining a survey instrument assembly at a fixed angular orientation with respect to a core barrel supported by the bottomhole assembly of a rotating drill string and rotationally isolated therefrom.

It is a common practice when drilling for oil to take a core sample of the formations being drilled and to subsequently analyze the sample in the laboratory with a view to obtaining information on the geology of the formations, particularly with a view to obtaining information on the quantity and distribution of formation hydrocarbons.

In one method of coring an assembly comprising an electronic multi-shot measurement instrument, a core barrel and a coring bit is attached to the end of the bottomhole assembly and the complete assembly is introduced into the borehole. The coring bit is then rotated by the drill string so as to cut a core sample which is taken up by the core barrel. After withdrawal of the assembly from the borehole, the core barrel containing the core sample is detached from the bottomhole assembly. In this method it is required that the core barrel and the survey instrument should be maintained at the same relative angular orientation and such that both are rotationally isolated from the drill string so that the orientation of the core sample when cut from the surrounding formations will be known. However, this is difficult to achieve since the drill string supporting the survey instrument and core barrel will rotate, and conventional attempts to rotationally isolate the survey instrument from the drill string have not proved satisfactory in practice.

It is an object of the invention to provide a down-hole bearing assembly which is capable of effectively maintaining the survey instrument assembly at a fixed angular orientation with respect to the core barrel during core cutting.

SUMMARY OF THE INVENTION

According to one aspect of the present invention there is provided a down-hole bearing assembly for maintaining a survey instrument assembly at a fixed angular orientation with respect to a core barrel supported by the bottomhole assembly of a rotating drill string and rotationally isolated therefrom, the bearing assembly comprising a centralizer sleeve having an inner bearing surface providing for rotation of the centralizer sleeve with respect to the survey instrument assembly and outer bearing surfaces providing for rotation of the centralizer sleeve with respect to the drill string, the outer bearing surfaces being located at the ends of vanes extending radially outwardly from the centralizer sleeve.

According to another aspect of the present invention there is provided a down-hole bearing assembly for supporting a down-hole instrument within a drill string and permitting relative rotation between the instrument and the drill string, wherein the bearing assembly comprises a centralizer sleeve having an inner bearing surface providing for rotation between the centralizer sleeve and an outer surface of the instrument and outer bearing surfaces providing for rotation between the centralizer sleeve and an inner surface of the drill string, and wherein the outer bearing surfaces are provided on radially outer portions of resilient vane members extending radially outwardly from the centralizer sleeve and adapted to flex radially inwardly to disengage the outer bearing surfaces when the instrument is to be moved along the drill string.

Such an arrangement is particularly advantageous as it permits the instrument to be securely supported for rotation within the drill string, whilst also enabling the instrument to be retrieved along the drill string by a wireline in per se known manner.

In a preferred embodiment the bearing assembly includes a support member adapted to be coupled to the instrument so as to have the same angular orientation as the instrument and having a cylindrical outer surface engaging the inner bearing surface of the centralizer sleeve.

The support member may have an annular shoulder for engaging one end of the centralizer sleeve. Conveniently the support member also has a detachable collar for engaging the other end of the centralizer sleeve so that the centralizer sleeve is confined between the shoulder and the collar. The support member may include screwthreaded connectors at its axial ends for connection to adjacent members.

It is preferred that the inner bearing surface of the centralizer sleeve incorporates flats extending axially of the centralizer sleeve and spaced angularly around the inner bearing surface.

The centralizer sleeve may also incorporate equiangularly spaced lands separated by radially extending grooves at at least one of its axial ends forming axial thrust bearing surfaces.

The resilient vane members may be bowed leaf springs which are attached at their ends to the centralizer sleeve and which are capable of being loaded so that at least their radially outer portions flex radially inwardly to disengage the outer bearing surfaces.

Furthermore the centralizer sleeve may comprise two sleeve portions which are connected together by the resilient vane members and each of which has a respective inner bearing surface providing for rotation between the sleeve portion and the outer surface of the instrument and allowing limited movement between the sleeve portions along the axis of the instrument.

The inner bearing surface of the centralizer sleeve may be formed by one or more cylindrical sleeve inserts having a relatively rigid annular shell and a lining of elastomeric material on the inside wall of the shell.

The lining preferably extends axially beyond one end of the shell to form the axial thrust bearing surfaces.

According to another aspect of the present invention there is provided a down-hole bearing assembly for maintaining a survey instrument assembly at a fixed angular orientation with respect to a core barrel supported by the bottomhole assembly of a rotating drill string and rotationally isolated therefrom, the bearing assembly comprising a hanger member adapted to be coupled to the survey instrument assembly so as to have the same angular orientation as the core barrel, an outer sleeve adapted to be coupled to the drill string so as to rotate with the drill string, and an annular roller or ball bearing unit positioned between an outer surface of the hanger member and an inner surface of the outer sleeve and allowing for rotation of the outer sleeve with respect to the hanger member.

In a preferred embodiment the bearing unit includes a plurality of roller bearings spaced around the outer surface of the hanger member and having axes of rotation which are inclined at a common angle with respect to the outer surface. The roller bearings may be tapered.

It is also preferred that the hanger member has a cylindrical outer surface and an annular flange extending radially outwardly from the outer surface, the bearing unit being engaged by both the outer surface and the flange of the hanger member.

It is similarly preferred that the outer sleeve has a cylindrical inner surface and an annular flange extending radially inwardly from the inner surface, the bearing unit being engaged by both the inner surface and the flange of the outer sleeve.

The hanger member conveniently includes screwthreaded connectors at its axial ends for connection to adjacent members.

BRIEF DESCRIPTION OF THE DRAWINGS

In order that the invention may be more fully understood, a preferred embodiment in accordance with the invention will now be described, by way of example, with reference to the accompanying drawings, in which.

DETAILED DESCRIPTION OF THE DRAWINGS

Figure 1:
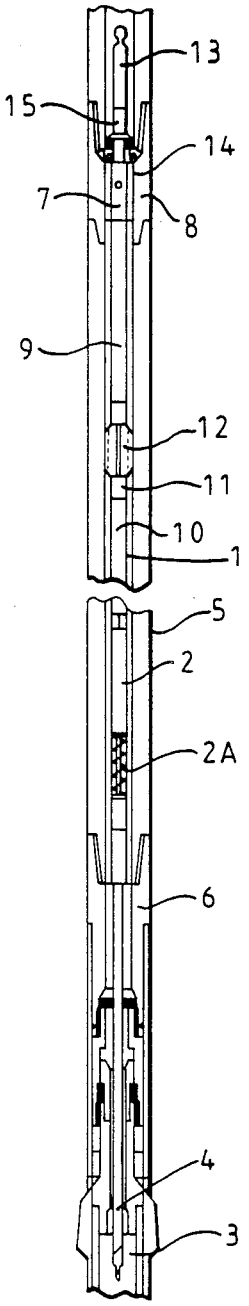
FIG. 1 is an axial section through part of a bottomhole assembly including an electronic multi-shot survey instrument assembly, a core barrel and a coring bit.

Referring to FIG. 1 the arrangement comprises an electronic multi-shot measurement instrument assembly 1, a spacer unit 2 and a core barrel 3 having an integral mule shoe coupling 4. The spacer unit 2 is held in engagement with the mule shoe coupling 4 by an axial slip joint 2A which comprises a cylindrical member extending axially within a cylindrical sleeve and being held therein by a key projecting from the cylindrical surface of the member and engaging within an axially extending slot in the cylindrical wall of the sleeve so as to permit limited sliding of the member within the sleeve against a compression spring acting between one end of the member and a closed end of the sleeve. The complete core barrel 3 is not shown in the figure, but it will be understood that this extends below the mule shoe coupling 4 and is of standard form. The assembly is located within the drill string 5 which includes a non-magnetic drill collar 6. Although not visible in the figure, a coring bit is located at the end of the drill string so as to be rotatable therewith.

The electronic multi-shot measurement instrument assembly 1 comprises an upper part 9 and a lower part 10. Furthermore a support sub 11 carrying a rotating centralizer 12 is connected between the upper part 9 and the lower part 10. In addition a centralizing bearing assembly 14 is located within the drill string 5 and includes a hanger sub 15 connected between a retrieval sub 13 and a weak point sub 7 which is in turn connected to the upper part 9. The hanger sub 15 is located within a hang-off sub 8 of the drill string 5. The weak point sub 7 is a thin-walled tube having a series of apertures through its wall providing a weak point at which a fracture will preferentially occur if the bearing assembly 14 should become rotationally jammed resulting in an excessive torque being applied to the weak point.

In operation of the assembly to obtain a core sample, the drill string 5 is lowered down the borehole with the core barrel 3 and coring bit attached to the end of the drill string 5 and with the electronic multi-shot measurement instrument assembly 1 located in a predetermined angular orientation with respect to the core barrel 3 by means of the mule shoe coupling 4. The coring bit is then rotated by rotating the drill string 5 so as to cut the core sample, and the core sample is taken up in the core barrel 3. During this operation the core barrel 3 and the electronic multi-shot measurement instrument 1 do not rotate with the drill string 5 but maintain a fixed orientation by virtue of the provision of the rotating centralizer 12 and the centralizing, bearing assembly 14 which rotationally isolate these components from the drill string 5.

Although, in the preferred embodiment, such rotational isolation is achieved by the provision of both a rotating centralizer 12 and a centralizing bearing assembly 14, it should be understood that other arrangements are possible in which one or other of these components is omitted and in which, for example, two rotating centralizers or two centralizing bearing assemblies are provided.

Figure 2:
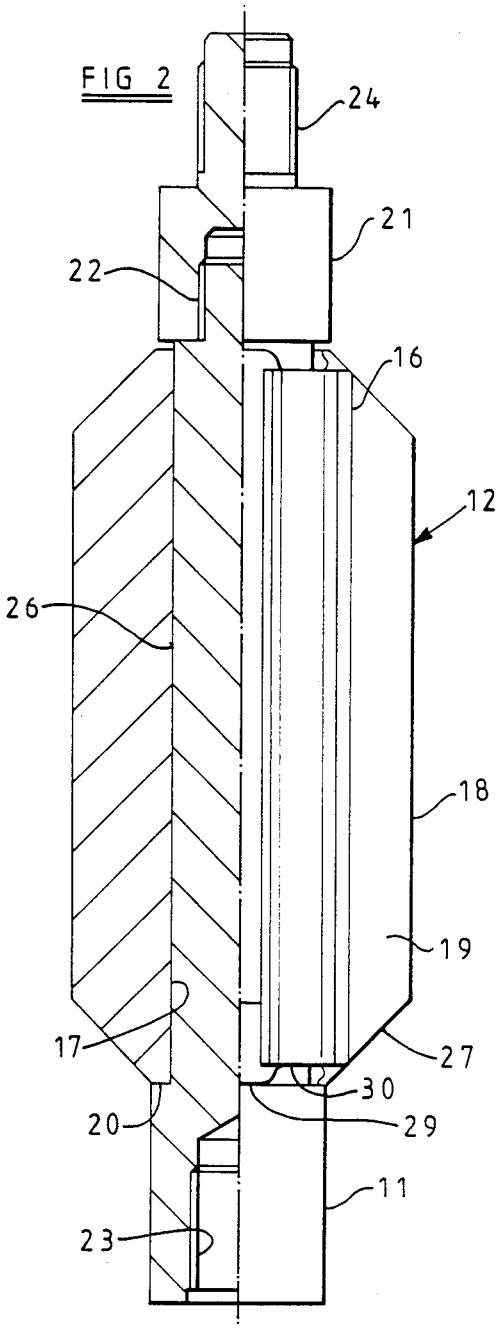
FIG. 2 is an enlarged view of a rotating centralizer of the bottomhole assembly, partly in axial section.

The rotating centralizer 12 will now be described in more detail with reference to FIGS. 2 and 3. The centralizer 12 is made from 80 Shore A nitrile rubber and comprises a sleeve 16 having an inner bearing surface 17 allowing for rotation of the sleeve 16 with respect to the support sub 11, and outer bearing surfaces 18 allowing for rotation of the sleeve 16 with respect to the surrounding drill string 5. The outer bearing surfaces 18 are located at the ends of four vanes 19 extending radially outwardly from the sleeve 16.

The support sub 11 has an annular shoulder 20 which is engaged by the sleeve 16, and a detachable collar 21 is connected to the upper end of the support sub 11 by a screwthreaded connection 22 so as to confine the sleeve 16 between the shoulder 20 and the collar 21. The support sub 11 has a screwthreaded recess 23 at its lower end for connection to the upper part 9, and the collar 21 has a screwthreaded projection 24 for connection to the sub 13.

Figure 3:
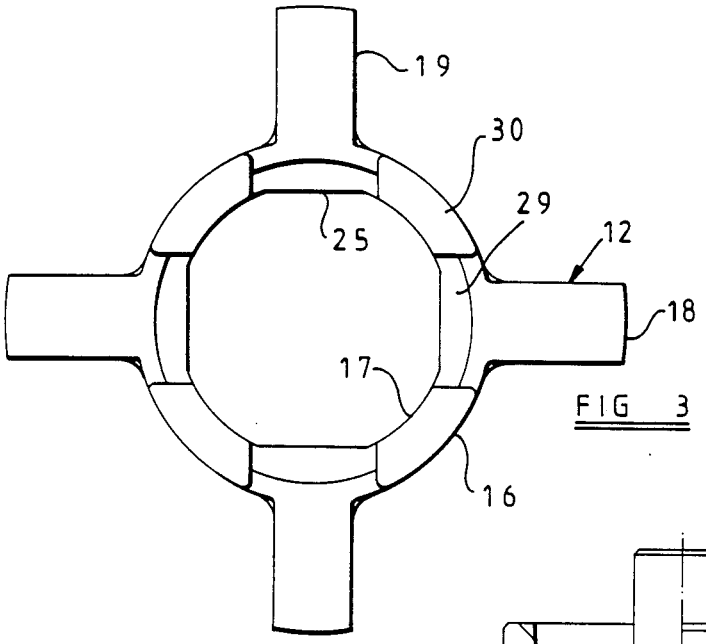
FIG. 3 is a cross-section through a sleeve of the rotating centralizer.
Figure 4:
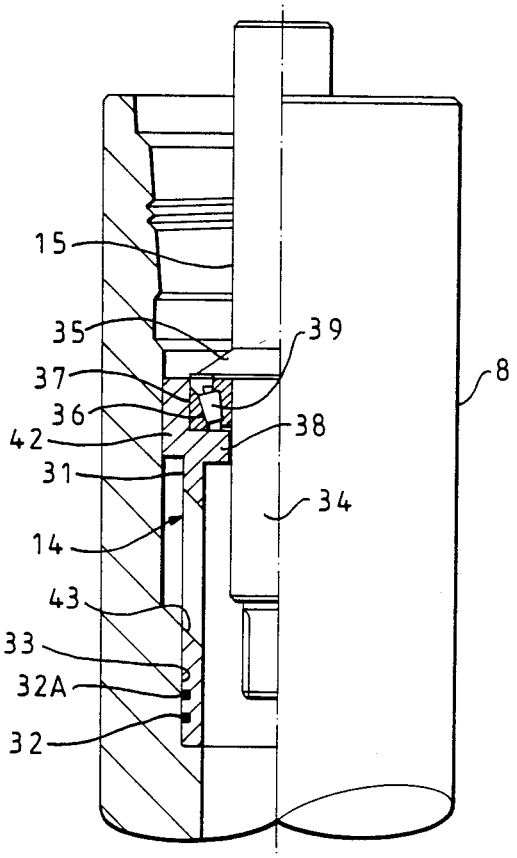
FIG. 4 is a view of a centralizing bearing assembly, partly in section.

As best seen in FIG. 3, the inner bearing surface 17 is formed with four flats 25 extending axially of the sleeve 16 and spaced angularly around the inner bearing surface 17. The flats 25 engage the cylindrical outer surface 26 of the support sub 11 and allow for rotation of the sleeve 16 on the support sub 11 whilst the bearing surfaces are lubricated by the mud flow which passes down the hollow space within the drill string 5 in operation. Furthermore the vanes 19 are chamfered at 27 at their axial ends and are transversely deflected to a limited extent when the sleeve 16 is introduced into the drill string 5 so that the vanes 19 are loaded against the inner wall of the drill string 5. This loading, combined with the tendency of the material of the sleeve 16 to swell within the mud flow, provides sufficient restraint to centralize the assembly within the drill string 5 and prevent substantial lateral movement of the assembly.

Furthermore each of the axial ends of the sleeve 16 is formed with four equiangularly spaced axial lands 29 separated by grooves 30, the angular positioning of the axial lands 29 corresponding to the axial positioning of the vanes 19 and the flats 25. The axial lands 29 define profiled axial bearing surfaces for engagement with the shoulder 20 and the collar 21. The form of all the bearing surfaces on the sleeve 16 and the material from which the sleeve 16 is made minimize the wear of these surfaces in the mud flow since the material of the bearing surfaces will tend to deform so as to ride over any abrasive particles in the mud flow.

The centralizing bearing assembly 14 will now be described in more detail with reference to FIGS. 4 to 8. The bearing assembly 14 comprises the hanger sub 15 which, as will be appreciated, will have the same angular orientation as the core barrel 3, and an outer sleeve 31 which is a force fit within the hang-off sub 8 and which is provided with annular grooves 32 for O-rings 32A which sealingly engage an inner cylindrical surface 33 of the hang-off sub 8. The outer sleeve 31 thus rotates with the drill string 5.

Furthermore the hanger sub 15 is formed with a cylindrical outer surface 34 and an annular flange 35 extending radially outwardly from the surface 34. An annular roller bearing unit 36 surrounds the outer surface 34 of the hanger sub 15 and engages the flange 35, and is in turn engaged by a cylindrical inner surface 37 of the outer sleeve 31 and an annular flange 38 extending radially inwardly from the inner surface 37. The roller bearing unit 36 comprises a plurality of tapered roller bearings 39 spaced around the outer surface 34 of the hanger sub 15 and having axes of rotation which are inclined at a common angle with respect to the outer surface 34.

Figure 6:
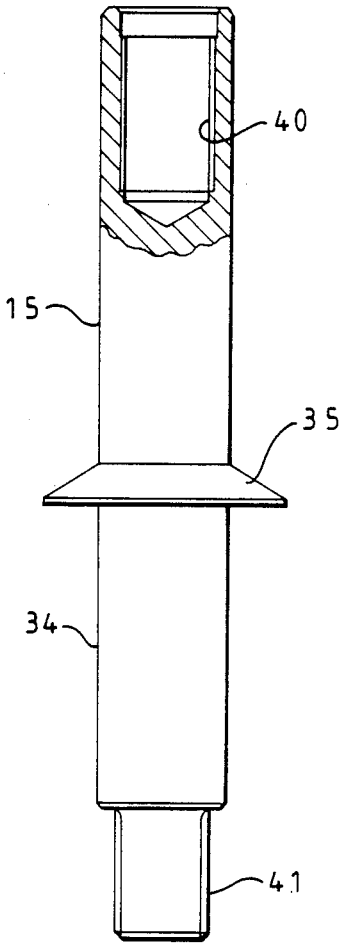
FIG. 6 is a view of a hanger sub of the centralizing bearing assembly, partly in axial section.

As best seen in FIG. 6, the hanger sub 15 has an internally screwthreaded recess 40 at one end for connection to the retrieval sub 13 and an externally screwthreaded projection 41 at the other end for connection to the weak point sub 7.

Figure 7:
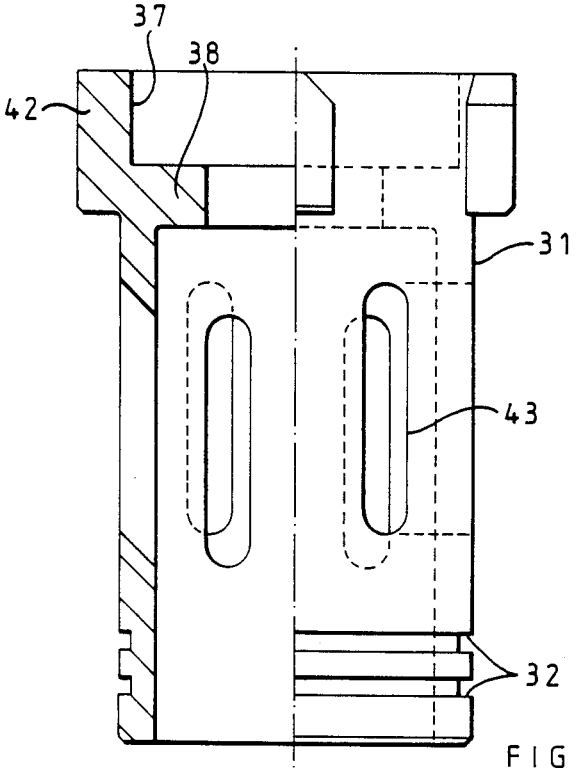
FIG. 7 is a view of an outer sleeve of the centralizing bearing assembly, partly in axial section.
Figure 8:
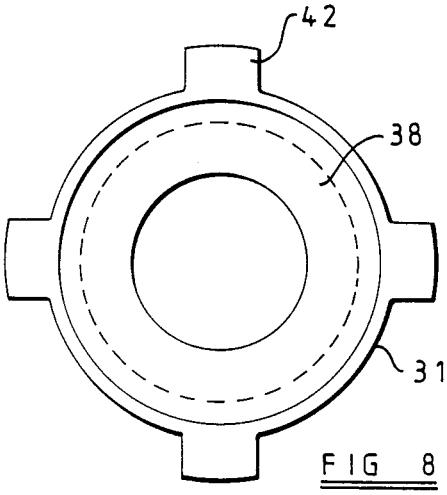
FIG. 8 is an end view from above of the outer sleeve of FIG. 7.

As best seen in FIGS. 7 and 8, the outer sleeve 31 has its upper end spaced from the inner surface of the drill string 5 by four radially outwardly extending tabs 42 permitting mud flow past the roller bearing unit 36. Furthermore slots 43 are formed in the outer sleeve 31 to allow the mud flow to pass from the annular space surrounding the sleeve 31 to the space within the sleeve 31.

Figure 5:
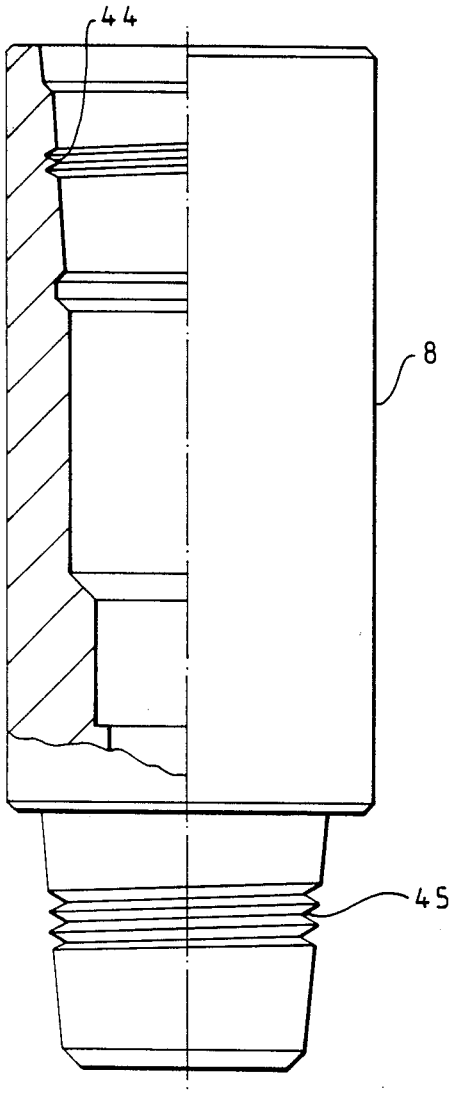
FIG. 5 is a view of a section of the bottomhole assembly accommodating the centralizing bearing assembly, partly in axial section.

Furthermore, as best seen in FIG. 5, the hang-off sub 8 has an internally screwthreaded connector 44 at one end and an externally screwthreaded connector 45 at the other end for connection to the adjacent sections of the drill string 5.

The above-described arrangement is particularly advantageous as it provides the necessary rotational isolation of the electronic multi-shot measurement instrument assembly without the assembly being subjected to axial movement or torsion in operation, whilst minimizing the transmission of shocks to the assembly. Furthermore the arrangement is effective both when drilling with oil base muds and when drilling with water base muds.

Two further embodiments of rotating centralizer in accordance with the invention will now be described with reference to FIGS. 9 to 12. These embodiments are specifically designed to enable the instrument assembly to be retrieved by a wireline which is lowered down the drill string and engaged with a fishing neck forming an integral part of the assembly prior to retrieval in per se known manner. Such an arrangement enables the instrument assembly, and possibly also the core sample to be brought to the surface without requiring withdrawal of the complete drill string from the borehole, and can therefore be advantageous in allowing the instrument assembly to be replaced during coring and in speeding up the complete coring process. On withdrawal of the instrument assembly in this process, the centralizer sleeve is also withdrawn, together with the hanger sub 15 (but not the outer sleeve 31) of the centralizing, bearing assembly. To enable the hanger sub 15 to be retrieved beyond drill string jars which serve to reduce the internal diameter of the drill string, it may be necessary to decrease the outer diameter of the flange 35 on the hanger sub 15.

Figure 10:
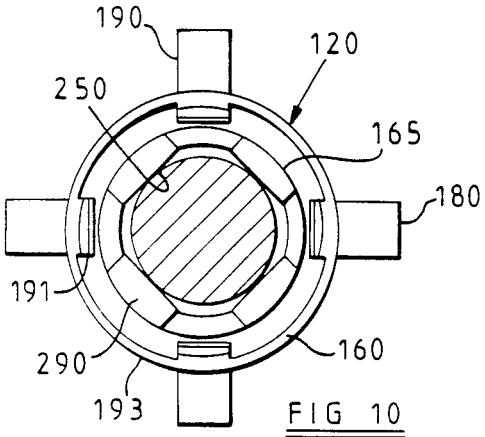
FIG. 10 is an end view taken along the line 10—10 in FIG. 9.
Figure 9:
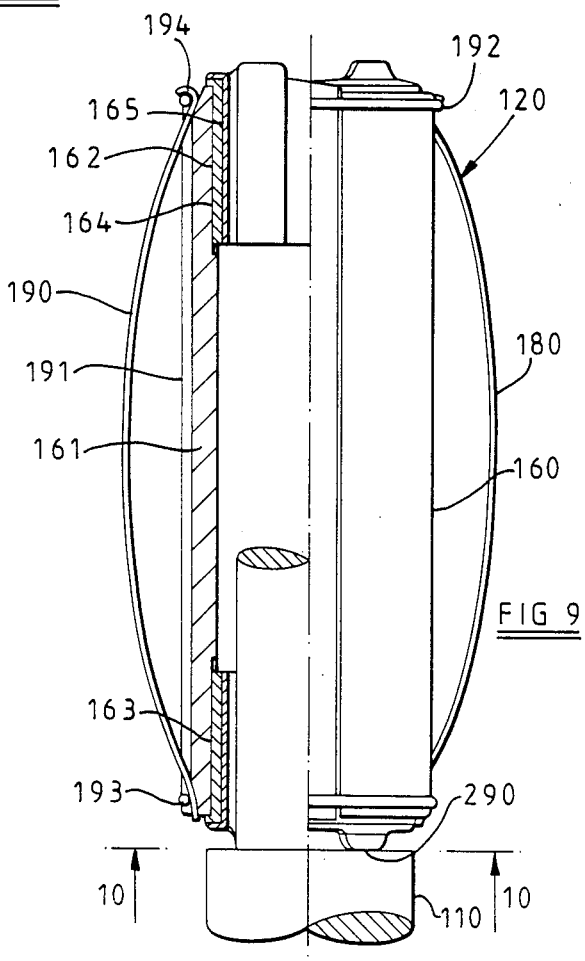
FIG. 9 is a view of an alternative rotating centralizer of the bottom hole assembly, partly in axial section.

Referring to the first alternative rotating centralizer 120 shown in FIGS. 9 and 10, this comprises a sleeve 160 rotatable on a support sub 110, in a manner similar to that already described. However, in this case the sleeve 160 consists of a metal tube 161 provided with cylindrical sleeve inserts 162 and 163 pressed into the ends of the tube 161. Each of the inserts 162 and 163 has a metal annular shell 164 and a lining 165 of elastomeric material (e.g. nitrile rubber) bonded onto the inside wall of the shell 164. The lining 165 is formed with four flats 250 engaging the cylindrical outer surface of the support sub 110 and allowing for rotation of the sleeve 160 on the support sub 110 as previously described. Furthermore the lining 165 extends axially beyond one end of the shell 164, and is turned over that end of the shell 164, so as to form four equiangularly spaced axial lands 290 serving as profiled axial bearing surfaces in the manner previously described.

Furthermore the sleeve 160 is provided with four equiangularly spaced resilient vane members in the form of leaf springs 190 which are attached at their ends to the ends of the sleeve 160 and which are bowed outwardly of the sleeve 160 so as to form outer bearing surfaces 180 at their radially outermost portions for engagement with the inner surface of the drill string. Four axial grooves 191 are formed in the sleeve 160 for accommodating the springs 190, and the ends of the springs 190 are held within the ends of these grooves 191 by split rings 192 and 193. If required annular grooves may be provided in the sleeve 160 for receiving the split rings 192 and 193. One end or both ends of each spring 190 may be turned over as shown at 194 as an aid to retaining the spring 190 within the associated groove 191. It should be noted that the grooves 191 are offset in relation to the flats 250 and the axial lands 290.

When the rotating centralizer 120 is drawn up the drill string on retrieval of the assembly, the outer bearing surfaces 180 are disengaged from the inner surface of the drill string by virtue of the fact that the springs 190 are flexed radially inwardly until they lie virtually parallel to the outside surface of the sleeve 160. Such flexing is accompanied by slight movement of the ends of the springs 190 axially outwardly of the split rings 192 and 193.

Figure 12:
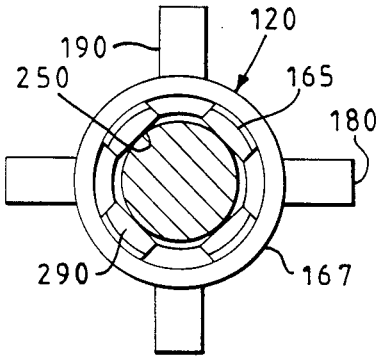
FIG. 12 is an end view taken along the line 12—12 in FIG. 11.
Figure 11:
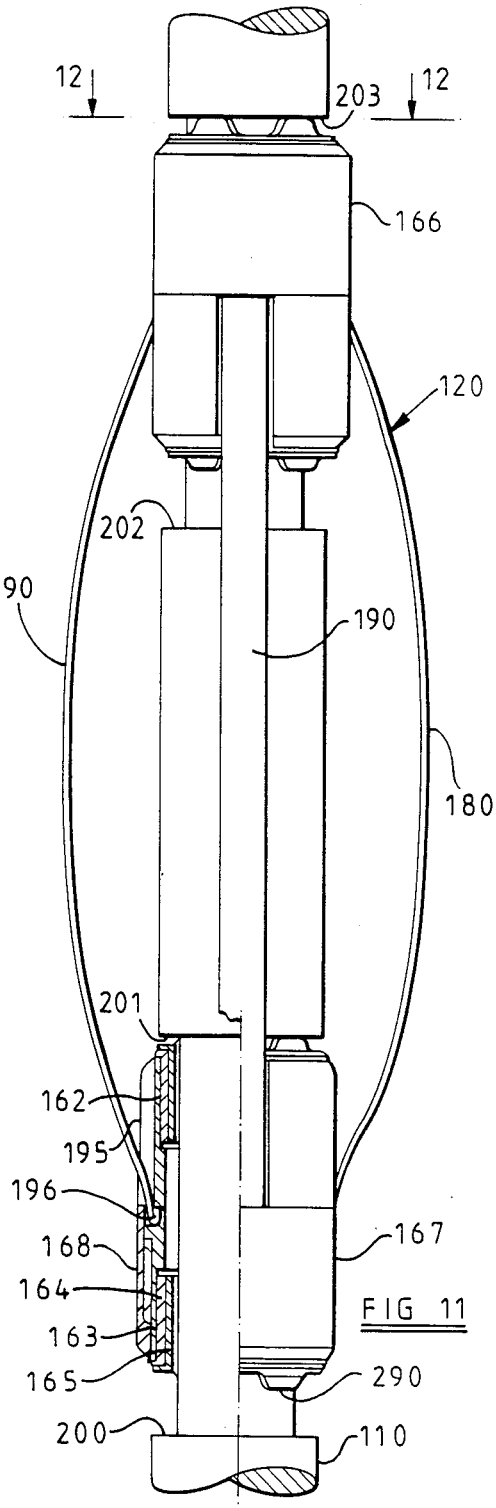
FIG. 11 is a view of a further alternative rotating centralizer, partly in axial section.

The further alternative rotating centralizer which is the subject of FIGS. 11 and 12 operates on broadly similar principles to the rotating centralizer just described, and accordingly the same reference numerals will be used to denote similar parts in these figures. However, in this embodiment, the centralizer sleeve comprises two similar sleeve portions 166 and 167 which are connected together by the springs 190 and which are capable of limited sliding movement along the support 110 between shoulders 200 and 201 and shoulders 202 and 203 respectively. Each of the sleeve portions 166 and 167 comprises a metal tube having a respective sleeve insert 162 or 163 pressed into each end and defining inner bearing surfaces, as well as axial bearing surfaces provided by axial lands 290.

Furthermore each of the sleeve portions 166 and 167 is provided with axial grooves 195 for guiding the springs 190. The ends 196 of the springs 190 are of T form and are held captive in T form slots in the sleeve portion 166 or 167 by means of a screw collar 168 having an internal screwthread which engages an external screwthread on the sleeve portion 166 or 167.

When the assembly is withdrawn along the drill string, the springs 190 are again caused to flex radially inwardly to disengage the outer bearing surfaces 180 from the inner surface of the drill string, with the sleeve portions 166 and 167 sliding relative to one another to take up the flexing movement.

It should be appreciated that the above described rotating centralizers, are not limited to the particular application described, and can also be used in other down-hole applications, such as in association with a down-hole steering tool or electronic single shot assembly.

We claim:

1. A down-hole bearing assembly for maintaining a survey instrument assembly at a fixed angular orientation with respect to a core barrel supported by a bottomhole assembly of a rotating drill string and rotationally isolated therefrom, the bearing assembly comprising a support member adapted to be coupled to the instrument so as to have the same angular orientation as the instrument and having a cylindrical outer surface, and a centralizer sleeve having an inner bearing surface providing for rotation of the centralizer sleeve with respect to the cylindrical outer surface of the support member and outer bearing surfaces providing for rotation of the centralizer sleeve with respect to a cylindrical inner surface of the drill string, the outer bearing surfaces being located at the ends of vanes extending radially outwardly from the centralizer sleeve, and the support member having an annular shoulder for engaging one end of the centralizer sleeve.

2. A bearing assembly according to claim 1, wherein the centralizer sleeve incorporates equiangularly spaced lands separated by radially extending grooves at at least one of its axial ends forming axial thrust bearing surfaces.

3. A down-hole bearing assembly for supporting a down-hole instrument within a drill string and permitting relative rotation between the instrument and the drill string, the bearing assembly comprising a support member adapted to be coupled to the instrument so as to have the same angular orientation as the instrument and having a cylindrical outer surface, and a centralizer sleeve having an inner bearing surface providing for rotation of the centralizer sleeve with respect to the cylindrical outer surface of the support member and outer bearing surfaces providing for rotation of the centralizer sleeve with respect to a cylindrical inner surface of the drill string, wherein the outer bearing surfaces are provided on radially outer portions of resilient vane members extending radially outwardly from the centralizer sleeve and adapted to flex radially inwardly to disengage the outer bearing surfaces from the cylindrical inner surface of the drill string when the instrument is to be moved along the drill string, and wherein the support member has an annular shoulder for engaging one end of the centralizer sleeve.

4. A down-hole bearing assembly for maintaining a survey instrument assembly at a fixed angular orientation with respect to a core barrel supported by a bottomhole assembly of a rotating drill string and rotationally isolated therefrom, the bearing assembly comprising a support member adapted to be coupled to the instrument so as to have the same angular orientation as the instrument and having a cylindrical outer surface, and a centralizer sleeve having an inner bearing surface providing for rotation of the centralizer sleeve with respect to the cylindrical outer surface of the support member and outer bearing surfaces providing for rotation of the centralizer sleeve with respect to a cylindrical inner surface of the drill string, the inner bearing surface having a substantially circular cross-section including a plurality of equiangularly spaced flats, and the outer bearing surfaces being located at the end of vanes extending radially outwardly from the centralizer sleeve.

5. A bearing assembly according to claim 4, wherein the centralizer sleeve incorporates equiangularly spaced lands separated by radially extending grooves at at least one of its axial ends forming axial thrust bearing surfaces.

6. A bearing assembly according to claim 4, wherein the resilient vane members are bowed leaf springs which are attached at their ends to the centralizer sleeve and which are capable of being loaded so that at least their radially outer portions flex radially inwardly to disengage the outer bearing surfaces from the cylindrical inner surface of the drill string.

7. A bearing assembly according to claim 4, wherein the centralizer sleeve comprises two sleeve portions which are connected together by the resilient vane members and each of which has a respective inner bearing surface providing for rotation between the sleeve portion and the cylindrical outer surface of the support member and allowing limited movement between the sleeve portions along the axis of the support member.

8. A down-hole bearing assembly for supporting a down-hole instrument within a drill string and permitting relative rotation between the instrument and the drill string, the bearing assembly comprising a support member adapted to be coupled to the instrument so as to have the same angular orientation as the instrument and having a cylindrical outer surface, and two coaxial centralizer sleeve portions spaced apart along the support member and interconnected by resilient vane members, each of the sleeve portions having a respective inner bearing surface providing for rotation of the sleeve portion with respect to the cylindrical outer surface of the support member and permitting limited relative axial movement between the sleeve portions along the support member to cause radially inward flexing of the vane members, and radially outer portions of the vane members constituting outer bearing surfaces providing for rotation of the bearing assembly with respect to a cylindrical inner surface of the drill string and being disengageable from the cylindrical inner surfce of the drill string when the instrument is to be moved along the drill string by relative movement between the sleeve portions to cause radially inward flexing of the vane members.

* * * * *

UNITED STATES PATENT AND TRADEMARK OFFICE

CERTIFICATE OF CORRECTION

PATENT NO. : 4,974,691

DATED : December 4, 1990

INVENTOR(S) : Peter Leaney et al

It is certified that error appears in the above-identified patent and that said Letters Patent is hereby corrected as shown below:

In Column 8, line 15, Claim 4 should be renumbered as Claim 7.

In Column 8, line 34, Claim 5 should be renumbered as Claim 4, and depend on Claim 3.

In Column 8, line 39, Claim 6 should be renumbered as Claim 5, and depend on Claim 3.

In Column 8, line 46, Claim 7 should be renumbered as Claim 6, and depend on Claim 3.

In Column 10, line 1, change "surfce" to -- surface --.

Signed and Sealed this

Twenty-eighth Day of July, 1992

*Attest:*

DOUGLAS B. COMER

*Attesting Officer*

*Acting Commissioner of Patents and Trademarks*